US005092500A

United States Patent [19]

Weber et al.

[11] Patent Number: 5,092,500

[45] Date of Patent: Mar. 3, 1992

[54] REFRACTORY DISCHARGE DEVICE WITH SEPARATE EXTERNAL REINFORCEMENT MEMBER

[75] Inventors: Udo Weber, Hochheim; Ernst Lührsen, Bad Schwalbach; Albert Ott, Waldems-Wüstems, all of Fed. Rep. of Germany; Steve Lee, Clydebank, Scotland

[73] Assignee: Didier-Werke AG, Wiesbaden, Fed. Rep. of Germany

[21] Appl. No.: 651,623

[22] Filed: Feb. 7, 1991

[30] Foreign Application Priority Data

Feb. 7, 1990 [DE] Fed. Rep. of Germany ..... 4003608

[51] Int. Cl.[5] ..... B22D 35/00

[52] U.S. Cl. ..... 222/607; 222/606

[58] Field of Search ..... 222/591, 606, 607; 266/236; 164/337, 335

[56] References Cited

U.S. PATENT DOCUMENTS 4,423,833 1/1984 Richter ..... 222/606
4,640,447 2/1987 Geller et al. ..... 222/607
4,858,794 8/1989 Sugiura et al. ..... 222/606

FOREIGN PATENT DOCUMENTS 2042897 10/1973 Fed. Rep. of Germany .
2936480 1/1981 Fed. Rep. of Germany .
3341524 5/1985 Fed. Rep. of Germany .

*Primary Examiner*—S. Kastler
*Attorney, Agent, or Firm*—Wenderoth, Lind & Ponack

[57] ABSTRACT

A refractory discharge device includes an immersion nozzle formed substantially of carbon-bonded magnesium oxide or carbon-bonded aluminum oxide or fused quartz. The immersion nozzle has therethrough a discharge passage and has an outer surface and an outlet end. An external reinforcement member is formed entirely separately from the immersion nozzle from a zirconium oxide material that is directly bonded without any carbon and by burning at a high temperature. The external reinforcement member is attached to the outer surface of the outer surface of the immersion nozzle at a position such that during use the external reinforcement member will extend above and below a casting powder covering of molten metal into which the refractory discharge device will be immersed.

20 Claims, 1 Drawing Sheet

REFRACTORY DISCHARGE DEVICE WITH SEPARATE EXTERNAL REINFORCEMENT MEMBER

BACKGROUND OF THE INVENTION

The present invention relates to a refractory discharge device for use in discharging molten metal, particularly molten steel, from a metallurgical vessel and which during use is immersed in the discharged molten metal. More particularly, the present invention relates to such a refractory discharge device including a refractory immersion nozzle that has attached to an outer surface thereof a separate refractory member that, during use of the refractory discharge device, extends above and below a casting powder covering or layer of the molten metal into which the refractory discharge device will be immersed. This separate and attached refractory member thus operates as an external reinforcement that is resistant to stresses created by the casting powder covering or layer.

A refractory discharge device is disclosed in German DE-PS 20 42 897. This device includes an external reinforcement that is attached to an immersion nozzle by means of threading, a bayonet lock or stops. The immersion nozzle and the external reinforcement member are made of the same refractory material.

In German DE-AS 29 36 480 there is disclosed an immersion nozzle having a refractory layer integrated into the material thereof at a region that is to be at the level of the upper surface of the molten metal. This layer is to contain, inter alia, 70 to 90 % zirconium oxide and 2 to 10 % carbon. This layer is fabricated as one piece with the immersion nozzle, and in practice this requirement causes difficulties. The carbon content of this layer is a drawback since it can burn out during use of the device. This creates an increase of porosity of the layer and thereby makes such layer susceptible to erosion. Another disadvantage is due to the fact that mechanical stresses that necessitate preparation for spalling of the layer under temperature stresses are generated due to the layer and the immersion nozzle being formed as one single integral member. Also, the refractory material of the immersion nozzle contains aluminum oxide and carbon. Carbon contributes to the bonding of the aluminum oxide during formation of the immersion nozzle and also provides advantageous thermal conductivity of the immersion nozzle. Thus, the immersion nozzle is erosion resistant with respect to the molten metal itself, particularly molten steel.

In German DE 33 41 524 C3 a refractory molded member made of partially stabilized zirconium dioxide is disclosed. This member is formed without carbon, and CaO, MgO or $Y_2O_3$ is provided for stabilization. This member is bonded directly without carbon and binder by burning at high temperatures ranging from 1600° to 2000° C.

SUMMARY OF THE INVENTION

With the above discussion in mind, it is an object of the present invention to provide an improved refractory discharge device of the above general type, but whereby it is possible to overcome the above and other prior art disadvantages.

It is a further object of the present invention to provide such a refractory discharge device having the properties of good erosion resistance of the immersion nozzle to the molten metal itself, particularly molten steel, but that which also provides improved erosion resistance of the external reinforcement member to the casting powder covering or layer, thereby extending the useful service life of the device.

It is a yet further object of the present invention to provide such a refractory discharge device whereby it is possible to form the immersion nozzle of a carbon-bonded magnesium oxide that, on the one hand, exhibits excellent corrosion resistance to molten steel, particularly oxygen-rich calcium alloyed and/or silicon-alloyed steels, but on the other hand, is very sensitive to corrosion by casting powder in the region of contact therewith. It is a more specific feature of this object of the invention to provide such a refractory discharge device wherein the immersion nozzle has attached thereto an external reinforcement member formed entirely separately of the immersion nozzle and mounted thereon, such external reinforcement being formed of a particular material highly resistant to corrosion by the casting powder.

The above objects are achieved in accordance with the present invention by the provision that the external reinforcement member is formed of zirconium oxide that is directly bonded without carbon by burning at a high temperature, while at the same time the immersion nozzle itself is formed substantially of carbon-bonded magnesium oxide or even carbon-bonded aluminum oxide or fused quartz.

Thus, in accordance with the refractory discharge device of the present invention, the immersion nozzle and the external reinforcement are made of different materials, with the material of the immersion nozzle itself being adapted to the stresses created by the molten metal, whereas the material of the external reinforcement is adapted to stresses created by the casting powder. Both elements, i.e. the immersion nozzle and the external reinforcement member, are manufactured separately so that the respective manufacturing conditions do not interfere. The external reinforcement member can be mounted by sliding on the exterior of the immersion nozzle. As a result, the external reinforcement member can be removed from the immersion nozzle and replaced by a new or different external reinforcement member. Additionally, immersion nozzles manufactured by previously known techniques can be retrofitted with external reinforcements manufactured in accordance with the present invention.

The external reinforcement is erosion resistant to the influence of the casting powder. This is due to the fact that the zirconium oxide of the external reinforcement is bonded without carbon. Due to its geometry, the external reinforcement also exhibits a high thermal shock resistance. The external reinforcement can be combined without any further effort with immersion nozzles that are made of carbon-bonded magnesium oxide, carbon-bonded aluminum oxide or fused quartz and that thus are erosion resistant to the molten metal itself, particularly molten steel.

In accordance with a particularly preferred feature of the present invention, an annular space or slot is defined between the outer surface of the immersion nozzle and the internal surface of the external reinforcement member in the cold state, i.e. at room temperature. This annular space or slot absorbs different thermal expansions of the two elements. Thus, during use of the refractory discharge device, the material of the immersion nozzle expands outwardly in the direction of the surrounding external reinforcement member without causing bursting or destruction thereof.

BRIEF DESCRIPTION OF THE DRAWINGS

The above and other objects, features and advantages of the present invention will become apparent from the following detailed description of preferred embodiments thereof, with reference to the accompanying drawings, wherein.

DETAILED DESCRIPTION OF THE INVENTION

Figure 1:
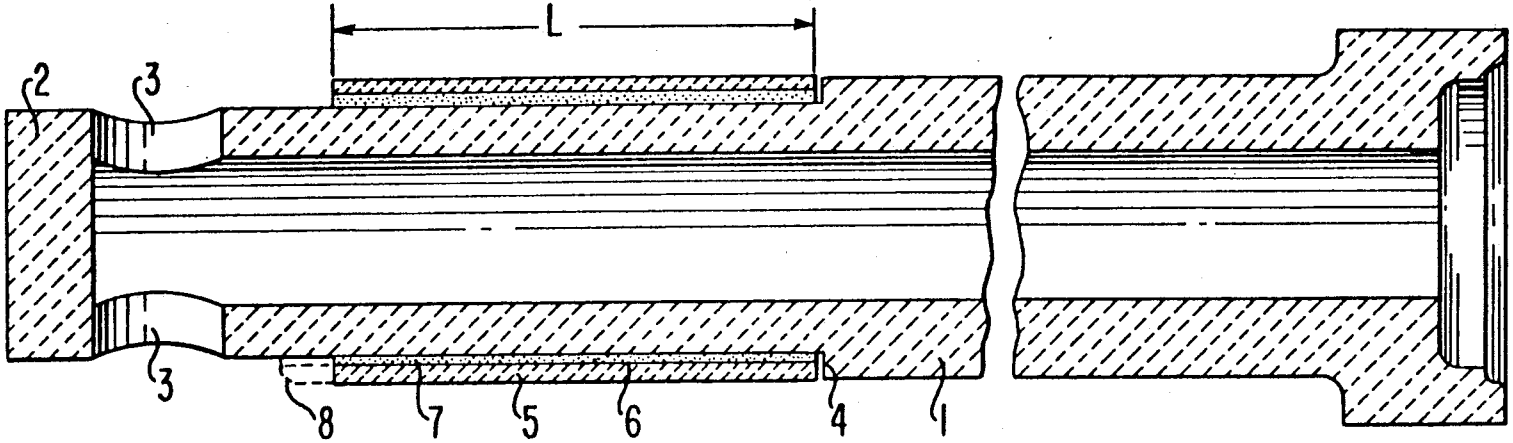
FIG. 1 is a cross-sectional view through a refractory discharge device in accordance with one embodiment of the present invention.
Figure 2:
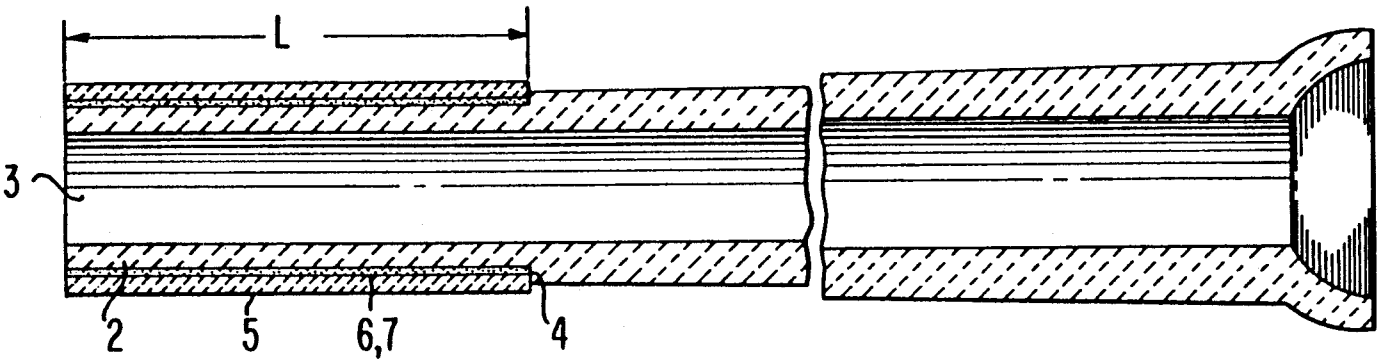
FIG. 2 is a similar view through a refractory discharge device in accordance with another embodiment of the present invention.

In the drawings are illustrated refractory discharge devices in accordance with the present invention. Each device includes an immersion nozzle 1 having therethrough a discharge passage to be employed for the discharge of molten metal, particularly molten steel. Each immersion nozzle 1 has an outlet end 2 having extending therethrough one or more discharge openings 3. In the embodiment of FIG. 1, plural discharge openings 3 extend outwardly from the discharge passage. In the embodiment of FIG. 2, a single discharge opening is illustrated to extend axially of the discharge passage.

During use of the refractory discharge device, it is intended to be immersed in the discharged molten metal, such that discharge opening or openings 3 are positioned below the upper level of the discharged molten metal. The immersion nozzles of the present invention are contemplated as being manufactured on the basis of carbon-bonded magnesium oxide or in the known manner on the basis of carbon-bonded aluminum oxide or fused quartz. Such materials have resistance to the stresses created by the molten metal itself, particularly molten steel.

A separate refractory sleeve forms an external reinforcement member 5 that is mounted about the outer surface of the immersion nozzle 1. In the illustrated arrangement, a step 4 is formed on the outer surface of immersion nozzle 1, and the outer surface of immersion nozzle 1 is cylindrical between step 4 and outlet end 2. The inner surface of external reinforcement member 5 is sized to be larger than the outer surface of the immersion nozzle 1, so that member 5 may be caused to slide over the outer surface of the nozzle from the outlet end 2 thereof, until an end of member 5 abuts step 4. Step 4 is arranged in such a manner that the length L of member 5 is dimensioned to be at a position such that during use the external reinforcement member 5 will extend above and below a casting powder covering of the molten metal, particularly molten steel, into which the device is immersed. In the embodiment of FIG. 1 the lower end of member 5 terminates above discharge openings 3. In the embodiment of FIG. 2, the member 5 extends entirely to the outlet end 2.

In the cold state, i.e. at room temperature, an annular space or slot 6 exists between the cylindrical outer surface of the immersion nozzle 1 and the cylindrical inner surface of member 5. Member 5 is mounted to be stably positioned in the axial direction of the immersion nozzle 1 by means of a cement or mortar layer 7 provided in space 6. Such cement or mortar layer 7 can be deformed in a manner that it yields to member 5 as a function of thermal expansion of the immersion nozzle 1 and can escape from opposite axial ends of space 6. Particularly, the refractory material of member 5 is substantially shape-stable at operating conditions of the device, at least with respect to the material of the immersion nozzle 1. In other words, member 5 will not undergo any substantial expansion during use of the device, whereas immersion nozzle 1 will expand outwardly at operating temperatures of the device.

External reinforcement member 5 is made of a carbon-free refractory material that contains up to 94 to 97 weight % zirconium oxide, preferably from 94 to 97 weight % zirconium oxide, and for stabilization 2 to 4 weight % calcium oxide, magnesium oxide, yttrium oxide or mixtures thereof. This material forming sleeve 5 is burned at temperatures ranging from 1600° to 2000° C.

Tests have shown that a refractory discharge device constructed as described above of separate immersion nozzle 1 and external reinforcement 5 has a significantly increased life compared to known refractory discharge devices of the prior art.

Instead of cement or mortar layer 7 provided to attach sleeve 5 to immersion nozzle 1, sleeve 5 also could be mounted and attached by means of projections of the immersion nozzle 1 that prevent displacement of sleeve 5. Projections of the immersion nozzle can project individually from the outer circumference thereof or can be in the form of annular members or threaded members. Thus, it is possible to attach member 5 to the immersion nozzle 1 by means of bayonet-type locking members or by threading connections. If the projection to attach the member 5 to the immersion nozzle 1 is a ring which forms a third separate component of the discharged device, then such ring can be formed of the same refractory material as the immersion nozzle and can be firmly cemented thereto. In so doing, space or slot 6 remains entirely free. Thus, member 5 is mounted by sliding loosely over the immersion nozzle 1 as far as stop 4. Subsequently, the separate ring is caused to slide over the outlet end 2 of the immersion nozzle until the ring almost makes contact with member 5. Such ring then is cemented in position on the immersion nozzle 1.

Instead of step 4, a separate ring also can be provided as an annular projection on the immersion nozzle 1 to retain the upper end of the member 5. Such ring also can be cemented on immersion nozzle 1 or can be connected thereto by means of threading or a bayonet lock. The ring or rings can be made of the same refractory material as the immersion nozzle since these rings will lie outside the region of the casting powder during use of the device and thus are not stressed by such casting powder. Indeed, formation of the rings of the same material as the immersion nozzle provides the advantage that such elements thereby will exhibit the same expansion properties. Additionally, such ring or rings and/or annular projection itself also can be made of a refractory cement or mortar material. In such case, the sleeve advantageously would be provided with a camphored edge, such as shown by dashed lines at 8 in FIG. 1.

Although the invention has been described and illustrated with respect to preferred features thereof, various modifications may be made to the specifically described and illustrated features without department from the scope of the present invention.

We claim:

1. A refractory discharge device for use in discharging molten steel from a metallurgical vessel and which during use will be immersed in the discharged molten steel, said refractory discharge device comprising:

an immersion nozzle formed substantially of one of carbonbonded magnesium oxide or carbon-bonded aluminum oxide or fused quartz, said immersion nozzle having therethrough a discharge passage and having an outer surface and an outlet end;

an annularly imperforate external reinforcement formed entirely separately from said immersion nozzle from zirconium oxide that is directly bonded without any carbon by burning at a high temperature, said external reinforcement having an inner surface and opposite open ends; and means for removably attaching said external reinforcement to said immersion nozzle at a position such that during use said external reinforcement will extend above and below a casting powder covering of the molten steel into which said refractory discharge device will be immersed, with said external reinforcement fitting over a portion of said immersion nozzle and with said inner surface of said external reinforcement confronting said outer surface of said immersion nozzle.

2. A device as claimed in claim 1, wherein said external reinforcement is made from a carbon-free material that contains up to 94 to 97 weight % zirconium oxide and for stabilization 2 to 4 weight % calcium oxide, magnesium oxide, yttrium oxide or a mixture thereof, and wherein said material is burned at a temperature of from 1600° to 2000° C.

3. A device as claimed in claim 1, wherein said external reinforcement is substantially shape-stable at operating temperatures encountered during use of said device.

4. A device as claimed in claim 3, wherein said outer surface of said immersion nozzle and said inner surface of said external reinforcement are dimensioned such that at room temperature said external reinforcement is capable of being mounted at said position on said immersion nozzle by being caused to slide over said outer surface thereof from said outlet end thereof.

5. A device as claimed in claim 4, wherein said outer and inner surfaces define therebetween an annular space.

6. A device as claimed in claim 5, wherein said attaching means comprises a deformable cement or mortar layer filling said annular space.

7. A device as claimed in claim 4, wherein an end of said external reinforcement spaced from said outlet end of said immersion nozzle abuts a step formed in said outer surface of said immersion nozzle.

8. A device as claimed in claim 1, wherein said attaching means comprise projections on said immersion nozzle for abutting opposite ends of said external reinforcement.

9. A device as claimed in claim 8, wherein said projections are annular.

10. A device as claimed in claim 9, wherein a first said annular projection comprises a step formed in said outer surface of said immersion nozzle and against which one end of said external reinforcement may abut, and a second said annular projection comprises a separate ring mounted on said immersion nozzle for retaining an opposite second end of said external reinforcement.

11. A device as claimed in claim 10, wherein said ring is cemented on said immersion nozzle.

12. A device as claimed in claim 10, wherein said ring is mounted on said immersion nozzle by threading or by a bayonet lock.

13. A device as claimed in claim 10, wherein said ring is formed of the same material as said immersion nozzle.

14. A device as claimed in claim 9, wherein said annular projections comprise two separate rings mounted on said immersion nozzle for retaining opposite ends of said external reinforcement.

15. A device as claimed in claim 14, wherein at least one of said rings is cemented on said immersion nozzle.

16. A device as claimed in claim 14, wherein at least one of said rings is mounted on said immersion nozzle by threading or by a bayonet lock.

17. A device as claimed in claim 14, wherein said rings are formed of the same material as said immersion nozzle.

18. A device as claimed in claim 9, wherein said annular projections are formed of refractory cement or mortar.

19. A device as claimed in claim 1, wherein said external reinforcement extends to said outlet end of said immersion nozzle.

20. A device as claimed in claim 1, wherein said external reinforcement has a lower end that terminates above at least one discharge opening at said outlet end of said immersion nozzle.

* * * * *